US005236315A

United States Patent [19]

Hamao et al.

[11] Patent Number: 5,236,315

[45] Date of Patent: * Aug. 17, 1993

[54] HYDRAULIC PUMP FOR POWER-ASSISTED STEERING SYSTEM

[75] Inventors: Miyoko Hamao; Kazuyoshi Ishizaki; Masahiko Hara, all of Atsugi, Japan

[73] Assignee: Atsugi Unisia Corporation, Atsugi, Japan

[ * ] Notice: The portion of the term of this patent subsequent to Mar. 24, 2009 has been disclaimed.

[21] Appl. No.: 712,946

[22] Filed: Jun. 10, 1991

[30] Foreign Application Priority Data

Jun. 11, 1990 [JP] Japan ..... 2-151893

[51] Int. Cl.[5] ..... F04B 49/00

[52] U.S. Cl. ..... 417/295; 417/300; 417/308; 417/310

[58] Field of Search ..... 417/300, 308, 310, 295

[56] References Cited

U.S. PATENT DOCUMENTS 4,597,718 7/1986 Nakano et al. ..... 417/300
4,838,767 6/1989 Ohe et al. ..... 417/308
5,098,259 3/1992 Ohtaki et al. ..... 417/300

FOREIGN PATENT DOCUMENTS 2001614 7/1971 Fed. Rep. of Germany .
2243430 3/1973 Fed. Rep. of Germany .
3212363 2/1983 Fed. Rep. of Germany .
61-278469 12/1986 Japan .
1459161 12/1976 United Kingdom .

*Primary Examiner*—Richard A. Bertsch
*Assistant Examiner*—Alfred Basichas
*Attorney, Agent, or Firm*—Bachman & LaPointe

[57] ABSTRACT

A hydraulic pump of the rotary vane type comprises a first throttle bore and a second throttle bore disposed in parallel between a pressure chamber of the pump and a delivery passage, and a variable flow throttle valve is provided which is responsive to a difference between a vane back-up pressure and a pressure within the delivery passage to vary an opening degree of the first throttle bore.

9 Claims, 3 Drawing Sheets

HYDRAULIC PUMP FOR POWER-ASSISTED STEERING SYSTEM

RELATED APPLICATION

U.S. patent application Ser. No. 07/572,894 filed on Aug. 24, 1990 by Nizuo OHTAKI et al. for "FLUID PUMP UNIT WITH FLOW CONTROL VALVE":

U.S. patent application Ser. No. 07/667,427 filed on Mar. 11, 1991 by Kazuyoshi HARA et al. for "ROTARY-VANE PUMP"; This U.S. patent application corresponds to German Patent Application No. P 41 08 126.9 filed on Mar. 13, 1991.

BACKGROUND OF THE INVENTION

The present invention relates to a hydraulic pump, and more particularly to a rotary-vane pump for power-assisted steering systems in motor vehicles.

In power-assisted steering systems for high speed vehicles, there is an increasing demand that with rising speed of travel the steering reaction should increase. This kind of reaction is intended to give the driver of the vehicle a reliable road feel even at high speeds. However, the increased delivery power of the pump at higher rotational speeds increase the hydraulic steering assistance, and the proportion of mechanical power to be supplied by the driver is reduced. A reliable road feel is therefore lost.

The invention aims at providing a hydraulic pump wherein with rising rotational speed of the pump, the delivery of pressure hydraulic fluid flow is reduced.

Specifically an object of the present invention is to provide a hydraulic pump which, without any external assistance, reduces the delivery of pressure hydraulic fluid flow at higher rotational speeds of the pump.

SUMMARY OF THE INVENTION

Accordingly, the present invention provides a hydraulic pump having an axis, a pressure chamber of the pump, a delivery passage in fluid communication with the pressure chamber, a cam ring with an internal cam surface, a rotor disposed within the cam ring and formed with radial slots, vanes guided in the slots of the rotor in slidable direct contact with the internal cam surface and reciprocable in the radial slots, respectively, in response to a rotational speed of the rotor relative to the cam ring, wherein a hydraulic fluid means is provided which is operative to supply hydraulic fluid to the radial slots of the rotor and includes means for throttling flow of hydraulic fluid discharge from each of the slots on the discharge stroke of the associated one of the vanes, and a variable flow throttle valve means is provided which is operative in response at least to a vane back-up pressure within each of the slots on the discharge stroke of the associated one of the vanes to throttle hydraulic fluid flow communication between the pressure chamber and the delivery passage.

DETAILED DESCRIPTION OF THE INVENTION

Figure 1:
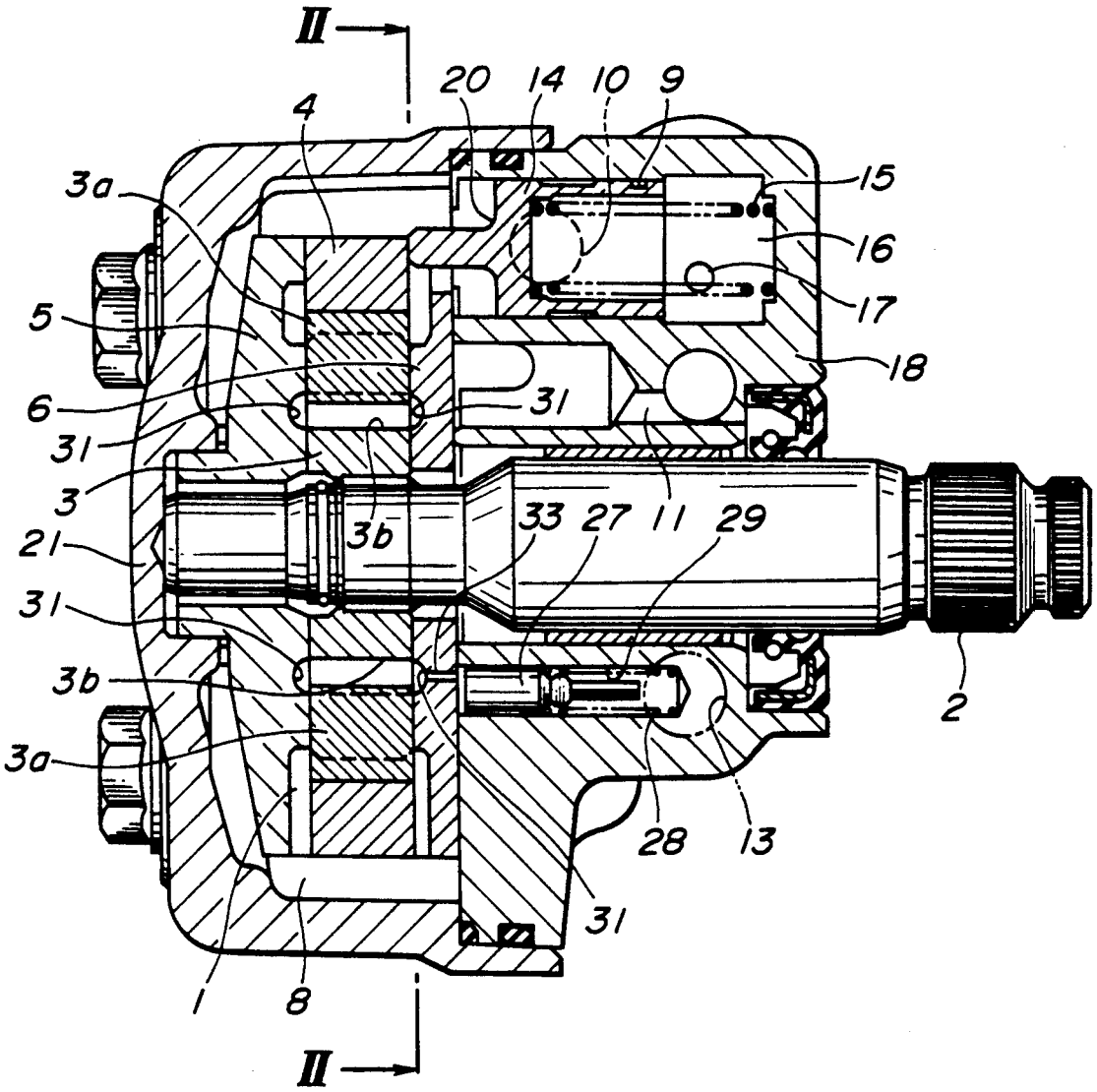
FIG. 1 is a longitudinal section through a hydraulic pump according to the present invention.
Figure 2:
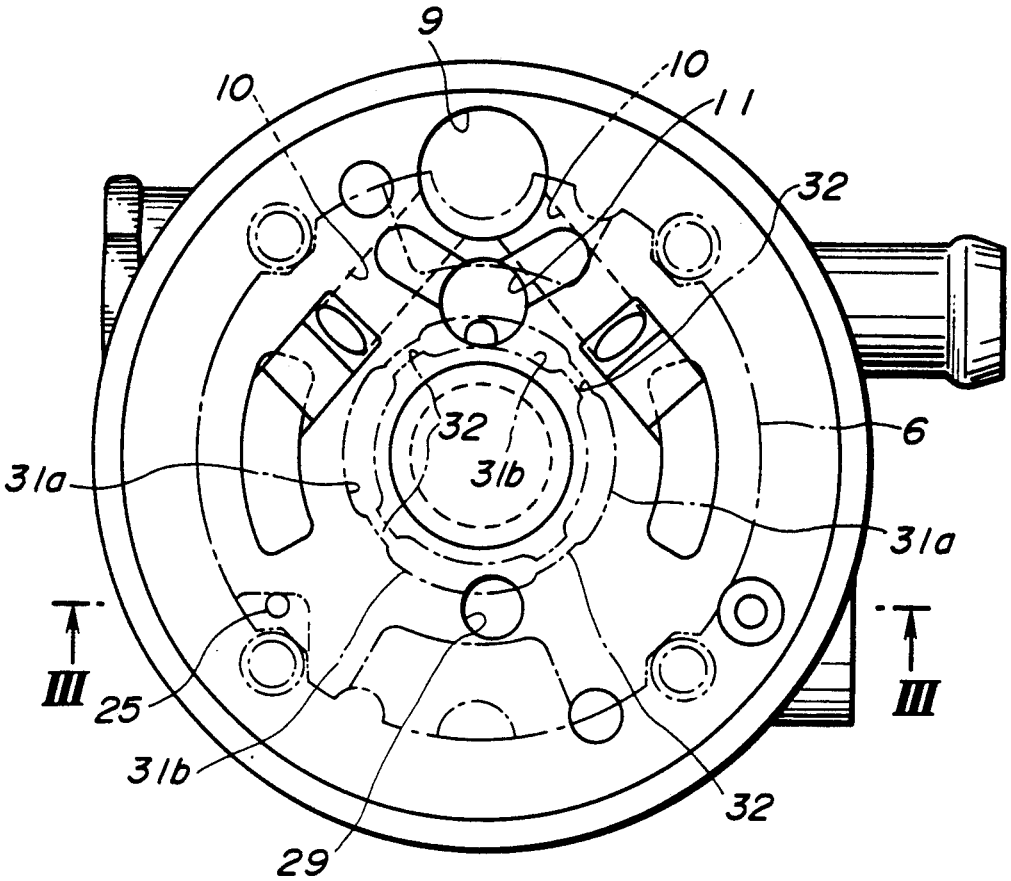
FIG. 2 is a section on the line II—II of FIG. 1 with an end plate shown in broken line.
Figure 3:
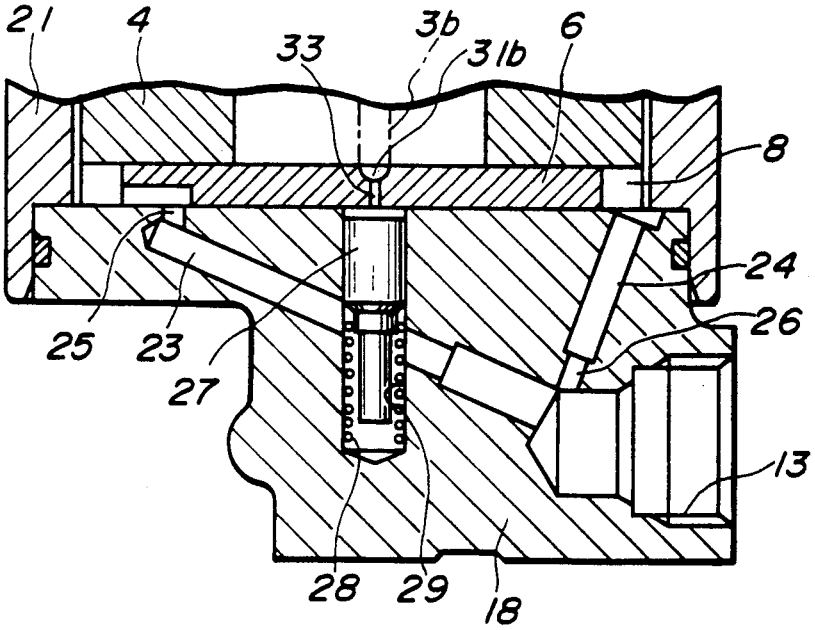
FIG. 3 is a partial section on the line III—III of FIG. 2.

Referring to FIG. 1, a casing 18, which is closed by a cover 21, contains a cam ring 4 disposed between two end plates 5 and 6. The cam ring 4 is formed with an internal cam surface and secured to the end plates 5 and 6 against rotation. A radially slotted, cylindrical rotor 3 connected to a driving shaft 2 is arranged in the cam ring 4. Vanes 3*a* are guided in the slots 3*b* (see FIG. 4) of the rotor 3 in slidable direct contact with the internal cam surface of the cam ring 4 and reciprocable in the radial slots 3*b*, respectively, in response to the rotational speed of the pump. Between the outer periphery of the cam ring 4 and the cover 21 there is formed in the cover 21 a pressure chamber 8 which collects pressure medium discharged radially outwardly past the cam ring 4 through apertures only one being shown at 1. Depending on the rotational speed of the pump, a flow control valve 20 allows pressure medium from the pressure chamber 8 to flow into a pair of drain passages, only one being shown at 10. The flow control valve 20 has a pressure responsive spool 14 received in a spool bore 9 in the casing 18. The bore 9 has one end directly opening to the pressure chamber 8 and the opposite end closed. The spool is biased by a spring 15 disposed in a back-up chamber 16 defined in the bore 9 between the spool 14 and the closed end of the bore 9. A port 17 opens to the back-up chamber 16 of the flow control valve 20. A delivery pressure is transmitted in a known manner to this port 17 from a delivery passage or port 13. From this delivery port 13, pressure medium is delivered to a consumer, which for example is constituted by a power-assisted steering system. As best seen in FIG. 3, the delivery port 13 is in communication with the pressure chamber 8 by means of a first throttle bore 23 and a second throttle bore 24 which are disposed in parallel between the pressure chamber 8 and the delivery port 13. As best seen in FIG. 2, the drain passages 10 extend through the casing 18 and communicate with a supply passage 11.

Pressure medium is supplied from the pressure chamber 8 to the slots 3*b* of the rotor 3 by hydraulic fluid means generally designated by the reference numeral 30. As best seen in FIG. 3, the hydraulic fluid means 30 includes two first grooves 31*a* and two second grooves 31*b*. Disposed between one of the first grooves 31*a* and the adjacent one of the second grooves 31*b* is a throttle groove 32. A set of these grooves 31*a*, 32*b* and 32 are formed in the end plate 6. The first grooves 31*a* are disposed within intake areas of the cam ring 4, and the second grooves are disposed within discharge areas of the cam ring 4. The first grooves 31*a* are in fluid communication with the pressure chamber 8 in a known manner. During rotation of the rotor 3, each of the vanes 3*a* reciprocates such that it moves radially outwardly as it passes each of the intake areas and then moves radially inwardly as it passes each of the discharge area. Thus, each of the first grooves 31*a* communicates with each of the slots 3*b* on the intake stroke of the associated one of the vanes 3*a*, and each of the second grooves 31*b* communicates with each of the slots 3*b* on the discharge stroke of the associated one of the vanes 3*a*. Pressure medium supplied to the first grooves 31*a* from the pressure chamber 8 is drawn into each of the slots 3b on the intake stroke of the associated one of the vanes 3a and thereafter discharged into the adjacent one of the second grooves 31b. Owing to the provision of the throttle grooves 32, hydraulic fluid discharge from the second groove 31b is restricted or throttled, so that a pressure within each of the second grooves 31b is always higher than a pressure within the pressure chamber 8 and increases in response to rotational speed of the pump.

Referring to FIGS. 1 and 3, a variable flow throttle valve is explained. This valve includes a valve spool 27 slidably disposed in a valve bore 29 formed in the casing 18. As best seen in FIG. 3, the valve bore 29 intersects the first throttle bore 23 downstream of an orifice 25. The valve bore has one end closed by the end plate 6 but communicating with the adjacent second groove 31b via a throttle passage 33 formed through the end plate 6. An opposite end of the valve bore 29 communicates with the delivery port 13. The valve spool 27 has one end exposed to a vane back-up pressure within the second groove 31b and an opposite end exposed to a delivery pressure within the delivery port 13. A spring 28 disposed in the valve bore 29 acts on the valve spool 27 to a spring set position as illustrated in FIG. 3. In this spring set position, the valve spool 27 fully opens the first throttle bore 23. As the vane back-up pressure increases, the valve spool 27 is urged against the spring 28 to reduce the opening degree of the first throttle bore 23.

In FIG. 3, the first throttle bore 23 has one end communicating with the orifice 25 opening to the pressure chamber 8 and an opposite end opening to the delivery passage 13, while the second throttle bore 24 has one end opening to the pressure chamber 8 and an opposite end communicating with an orifice 26 opening to the delivery passage 13. Thus, the first and second throttle bores 23 and 24 are disposed in parallel between the pressure chamber 8 and the delivery passage 13.

Figure 4:
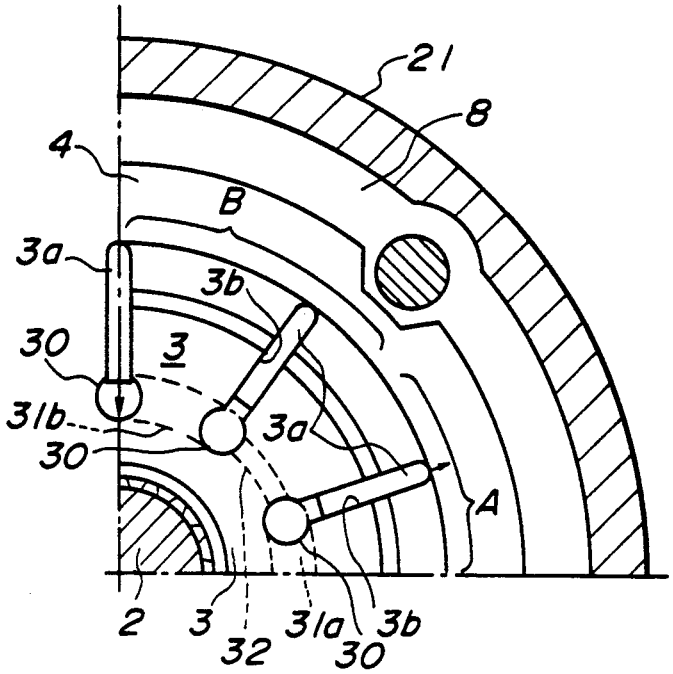
FIG. 4 is a diagram for explaining the operation.

The operation is explained in connection with FIGS. 4 and 5. In FIG. 4, the reference character A shows an intake area of the cam ring 4, while the reference character B a discharge area of the cam ring 4. During rotation of the rotor 3 counterclockwise viewing in FIG. 4, the slot 3b on the intake stroke of its vane 3a draws in pressure medium from the first groove 31a and the slot 3b on the discharge stroke of the vane 3a discharges pressure medium into the second groove 31b. As best seen in FIG. 4, each of the slots 3b is enlarged at the bottom as shown by the reference numeral 30.

Figure 5:
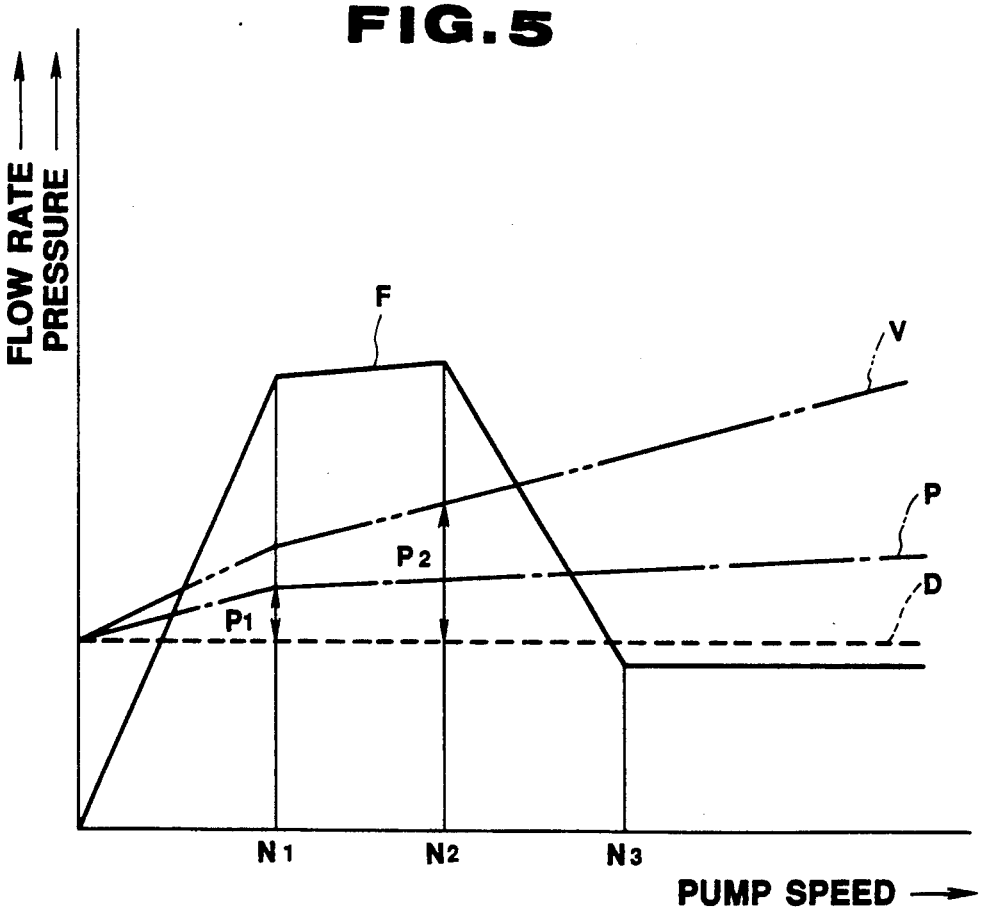
FIG. 5 is a graph showing the relationship between the delivery flow and the rotational speed of the pump and the relationship between various pressures and the rotational speed of the pump.

In FIG. 5, the dotted line D shows a delivery pressure within the delivery passage 13, the on-dot chain line P shows a pressure within the pressure chamber 8, and the two-dot chain line shows a vane back-up pressure V within the second groove 31b. The fully drawn line F shows a flow rate of pressure medium delivered by the delivery passage 13.

When the rotational speed of the pump is lower than a speed $N_1$, the flow control valve 20 and the variable flow throttle valve 27 are both in the spring set positions as illustrated in FIG. 1. Thus, the flow rate increases with increasing rotational speed. At the speed $N_1$, a difference between the pressure within the pressure chamber 8 and the delivery pressure within the delivery passage 13 reaches a value $P_1$ high enough to overcome the force of the spring 15 to urge the spool 14 of the flow control valve 20 to open the drain passage 10, allowing pressure medium to flow from the pressure chamber 8 into the drain passages 10. Thus, the flow rate increases slightly with increasing rotational speed. At a rotational speed $N_2$ that is higher than $N_1$, a difference between the vane back-up pressure within the second groove 13b and the delivery pressure within the delivery passage 13 reaches a value $P_2$ high enough to overcome the force of the spring 28 of the variable flow throttle valve 27. Thereafter, the spool 27 gradually closes opening degree of the first throttle bore 23. Thus, the flow rate reduces with increasing rotational speed. At a rotational speed $N_3$ that is higher than $N_2$, the first throttle bore 23 is completely closed. Thereafter, the flow rate remains substantially constant with increasing rotational speed beyond $N_3$.

What is claimed is:

1. A hydraulic pump having an axis, a pressure chamber of the pump, a delivery passage in fluid communication with the pressure chamber, a cam ring with an internal cam surface, a rotor disposed within the cam ring and formed with radial slots, vanes guided in the slots of the rotor in slidable direct contact with the internal cam surface and reciprocable in the radial slots, respectively, in response to a rotational speed of the rotor relative to the cam ring, wherein a hydraulic fluid means is provided which is operative to supply hydraulic fluid to the radial slots of the rotor and includes means for throttling flow of hydraulic fluid discharge from each of the slots on the discharge stroke of the associated one of the vanes, and a variable flow throttle valve means is provided which is operative in response at least to a vane back-up pressure within each of the slots on the discharge stroke of the associated one of the vanes to throttle hydraulic fluid flow communication between the pressure chamber and the delivery passage.

2. A hydraulic pump as claimed in claim 1, wherein said hydraulic fluid means includes first groove means communicating with each of the slots on the intake stroke of the associated one of the vanes and second groove means communicating with each of the slots on discharge stroke of the associated one of the vanes, and said throttling means is disposed between said first and second groove means.

3. A hydraulic pump as claimed in claim 2, wherein said first groove means is in fluid communication with the pressure chamber.

4. A hydraulic pump as claimed in claim 2, wherein said variable flow throttle valve means includes a valve spool having one end exposed to the vane back-up pressure within said second groove means.

5. A hydraulic pump as claimed in claim 4, wherein said valve spool has an opposite end exposed to a hydraulic pressure within the delivery passage.

6. A hydraulic pump as claimed in claim 5, wherein a first throttle bore and a second throttle bore are disposed in parallel between the pressure chamber and the delivery passage, and wherein said spool valve element is movable into said first throttle bore to vary opening degree thereof.

7. A hydraulic pump as claimed in claim 6, wherein said variable flow throttle valve means includes a valve bore intersecting said first throttle bore, said valve bore having one end communicating via a throttle port with said second groove means and an opposite end communicating with the delivery passage.

8. A hydraulic pump as claimed in claim 7, wherein said valve spool is disposed in said valve bore and resiliently biased toward said one end of said valve bore by means of a spring.

9. A hydraulic pump as claimed in claim 8, includes a flow control valve means responsive to a difference between a hydraulic pressure within the pressure chamber and the hydraulic pressure within the delivery passage for discharging hydraulic fluid from the pressure chamber.

* * * * *